United States Patent [19]

Petrick et al.

[11] Patent Number: 4,793,082

[45] Date of Patent: Dec. 27, 1988

[54] REMOVABLE DISPLAY STRUCTURE

[76] Inventors: Mary E. Petrick, 4505 Grace St., White Bear Lake, Minn. 55110; Timothy Morrissey, 894 Shirley La., Shoreview, Minn. 55126

[21] Appl. No.: 98,898

[22] Filed: Aug. 17, 1987

[51] Int. Cl.[4] ..... G09F 7/22

[52] U.S. Cl. ..... 40/617; 40/607; 40/611

[58] Field of Search ..... 40/607, 60 G, 10 B, 40/10 D, 615, 617, 584, 610, 611, 159, 124.2, 908

[56] References Cited

U.S. PATENT DOCUMENTS

| | | | |
|---|---|---|---|
| 1,773,346 | 8/1930 | Collins | 40/617 |
| 2,052,771 | 9/1936 | Johnson | 40/617 |
| 4,024,660 | 5/1977 | Goto | 40/10 D |
| 4,258,494 | 3/1981 | Borque | 40/607 |

FOREIGN PATENT DOCUMENTS

| | | | |
|---|---|---|---|
| 704578 | 3/1965 | Canada | 40/606 |
| 1058247 | 2/1967 | United Kingdom | 40/606 |

*Primary Examiner*—Gene Mancene
*Assistant Examiner*—Cary E. Stone
*Attorney, Agent, or Firm*—Leo Gregory

[57] ABSTRACT

A removable coverall display device to overlie a free standing real estate "For Sale" sign which sign consists of a rigid plate member supported from the cross arm of a ground secured post, the display device consisting of a pair of opposed sides of flexible material closed at one end and open at the top, bottom and at the other end thereof to overlie the plate member, the other end being adapted to be releasably closed and releasable hanger strips extending over the top of the rigid plate member to secure the device and the device prominently displaying the identity of the person on duty at the site of the sign.

1 Claim, 2 Drawing Sheets

REMOVABLE DISPLAY STRUCTURE

BACKGROUND OF THE INVENTION

1. Field of Invention

This invention relates to a readily removable flexible sign adapted to overlie a rigid fixed in position sign.

2. Description of the Prior Art

The commonly used "For Sale" real estate sign is made up of a rigid plate member suspended from the cross arm of a ground supported post.

Such a sign generally bears only the identification of the real Estate company having the listing for a given property. Such a sign remains in position until the premises are sold. Different sales persons at different times hold open houses of the same premises and want their personal identification on the sign to be known to the callers while they hold or host open houses. Informal means are presently used such as attaching name bearing strips to the standing sign.

SUMMARY OF THE INVENTION

It is desirable to have suitable means to identify the sales person on duty on the site of premises for sale.

It is an object of this invention to provide a portable sign for each sales person which may readily be mounted onto a fixed in place real estate sign.

It is another object of this invention to provide a flexible sign which may be slipped over the hanging plate of a fixed in position sign and is releasably secured thereto and which prominently displays the identity of the person on duty on the premises indicated by the sign.

It is also an object herein to provide a personal identification sign which is collapsible and readily portable by the person to whom it relates.

These and other objects and advantages of the invention will be set forth in the following description made in connection with the accompanying drawings in which like reference characters refer to similar parts throughout the several views.

DESCRIPTION OF A PREFERRED EMBODIMENT

Figure 1:
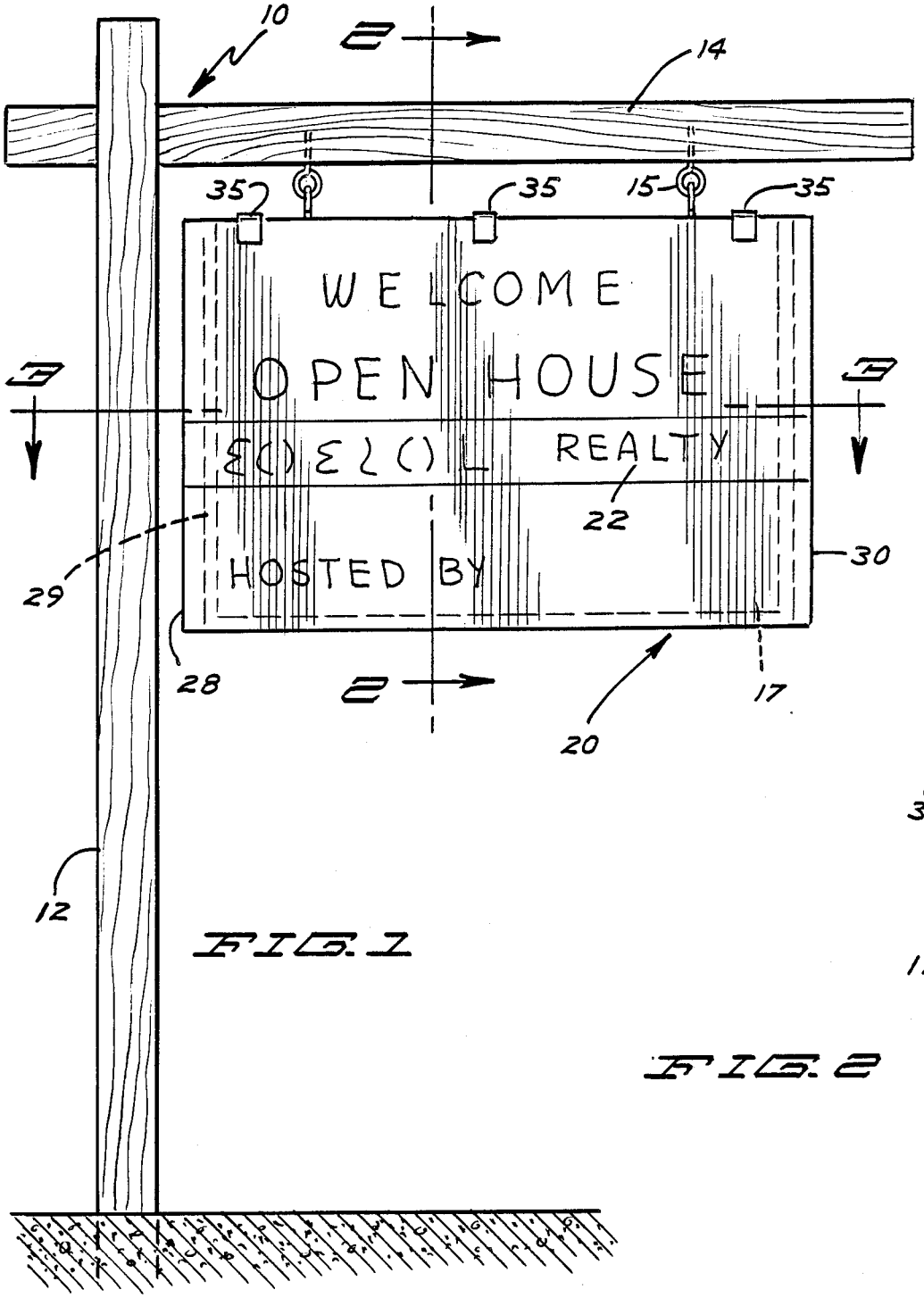
FIG. 1 is a front elevational view.
Figure 2:
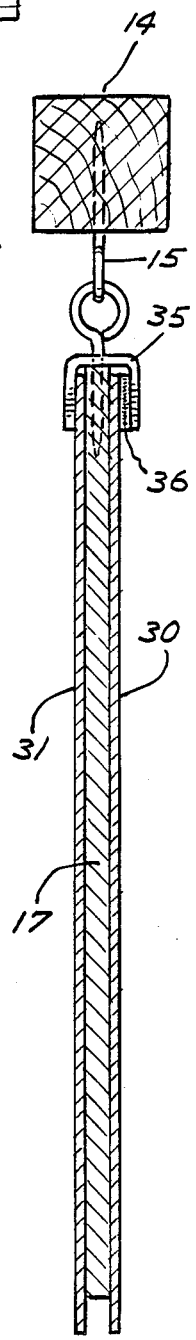
FIG. 2 is a view in vertical section taken on line 2—2 of FIG. 1 as indicated.
Figure 3:
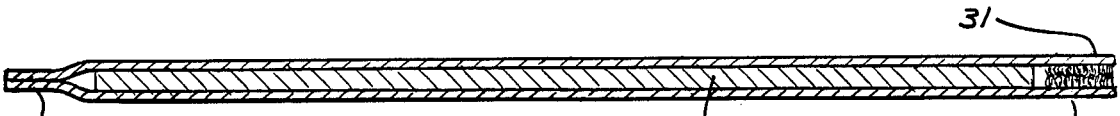
FIG. 3 is a view in horizontal section taken on line 3—3 of FIG. 1 as indicated.
Figure 4:
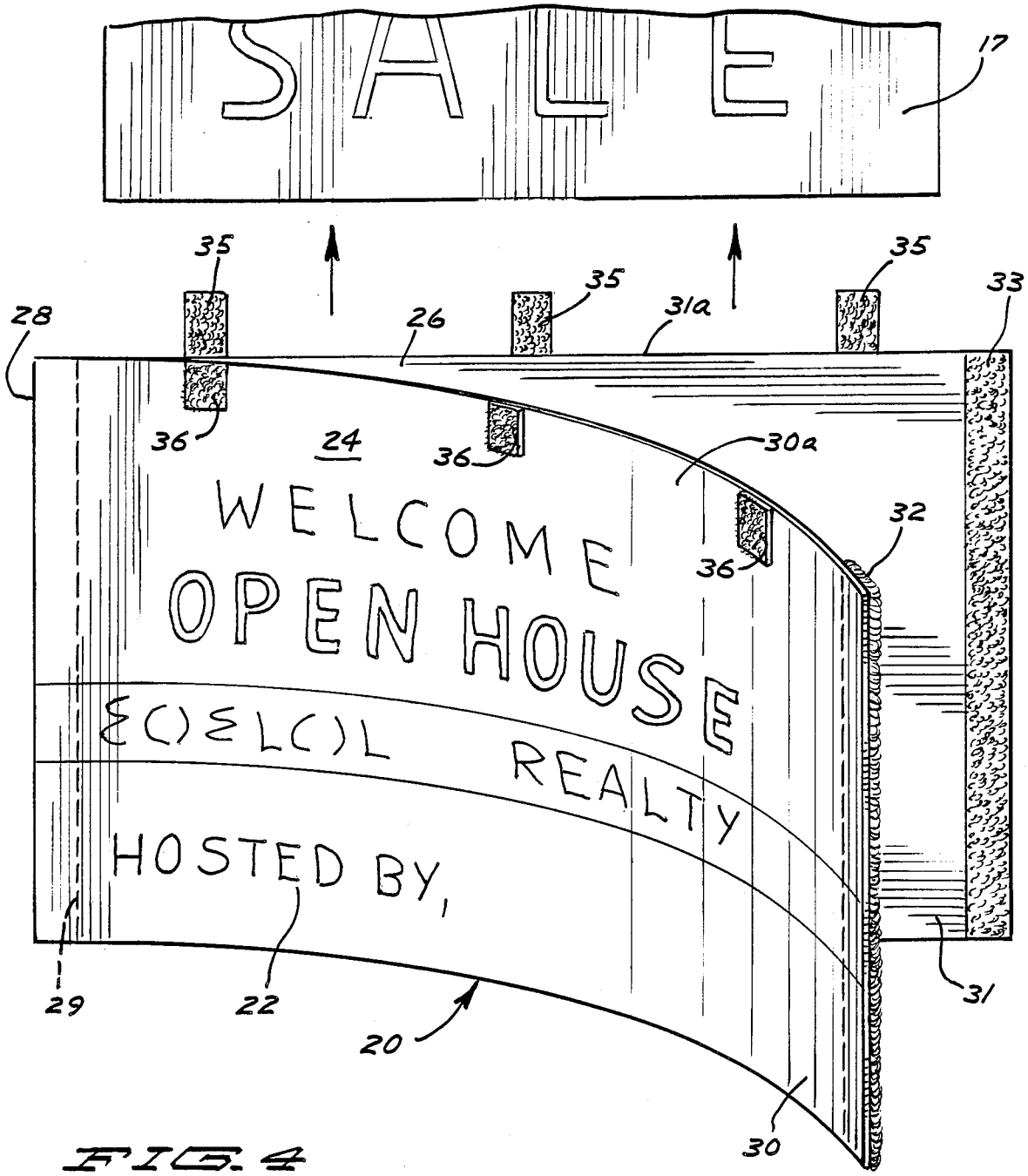
FIG. 4 is a front elevational view showing the device herein in a partially separated condition.

Referring to the drawings and particularly to FIG. 1, a commonly used fixed in position real estate "For Sale" sign is indicated by the reference numeral 10 consisting of an upstanding ground supported post 12 having a cross arm 14 extending therefrom and hanging from said cross arm by hooks 15 is a rigid plate member 17 made up as a "For Sale" sign. The indicia generally present on the rigid plate member is not shown here.

The display device of the invention herein is indicated generally by the reference numeral 20. Said device is preferably made up of a suitable flexible material having suitable weather resistant indicia thereon as indicated at 22. Such material may be a suitable plastic material.

Said device is made up of opposed sides 24 and 26 of a size to overlie and extend somewhat beyond the ends and bottom of the rigid plate member 17. An elongated piece of material .may be folded double to form the opposed sides resulting in a closed end 28 and said end may also be stitched as at 29.

The end 30 and 31 opposite the closed end 28 are here shown having mating "releasable closing means, such as Velcro". 32 and 33 attached to their facing free end portions as shown to form a releasable closure.

Secured to the outer upper edge portion 31*a* of the side 36 and spaced thereacross are "flexible releasable securing means, such as Velcro" velcro strips 35 which fold over the upper edge portion 30*a* of the side 24 to attach to mating "flexible securing means, such as Velcro" velcro tabs 36.

The device 20 is very readily put into operating position. With the ends 30 and 31 simply spread apart, the device is raised to have its sides overlie the rigid plate member 17, the ends 30 and 31 are secured together and the velcro strips 35 are extended over the upper edge of the rigid plate member 17 onto the side 30 to be secured to the tabs 36. Thus the display device 20 is put into operating position. Such devices are readily carried about by the persons whose identities they bear and when such persons are having an open house, their individual signs are readily installed.

It will of course be understood that various changes may be made in the form, details, arrangement and proportions of the product without departing from the scope of applicant's invention which, generally stated, consists in a product capable of carrying out the objects set forth, such a disclose and defined in the appended claims.

What is claimed is:

1. A portable display device having indicia thereon to be used with a fixed in position real estate sign which includes a rigid hanging plate sign member being hung, at its upper edge portion, comprising:

a pair of opposed side panels of somewhat larger size than that of said rigid plate member to be disposed at each side of said rigid plate member, said panels having one end portion unitary and having an opposite end portion carrying a releasable closure, said side panels having upper edge portions and secured to an upper edge portion of one of said panels are flexible releasable strap-like securing means disposed over said upper edge of said rigid plate member and releasably secured to the upper edge portion of the other of said panels, whereby said panels envelop said rigid plate and overlay it with the indicia carried by said panels.

* * * * *